US005711380A

United States Patent [19]

Chen

[11] Patent Number: 5,711,380

[45] Date of Patent: Jan. 27, 1998

[54] ROTATE PERCUSSION HAMMER/DRILL SHIFT DEVICE

[76] Inventor: Yueh Chen, 9-5., F1. No. 149, Sec. 2, Chi-Lung Rd., Taipei, Taiwan

[21] Appl. No.: 795,661

[22] Filed: Feb. 6, 1997

[51] Int. Cl.[6] ..... B25D 11/04

[52] U.S. Cl. ..... 173/48; 173/109

[58] Field of Search ..... 173/48, 109, 104, 173/205

[56] References Cited

U.S. PATENT DOCUMENTS

| | | | |
|---|---|---|---|
| 4,489,792 | 12/1984 | Fahim et al. | 173/48 |
| 5,375,665 | 12/1994 | Fanchang et al. | 173/48 |
| 5,456,324 | 10/1995 | Takagi et al. | 173/48 |
| 5,458,206 | 10/1995 | Bourner et al. | 173/48 |
| 5,531,278 | 7/1996 | Lin | 173/48 |

*Primary Examiner*—Scott A. Smith

*Attorney, Agent, or Firm*—Bacon & Thomas

[57] ABSTRACT

A rotate percussion hammer/drill shift device suitable for hand drill is provided. It is disposed at an output spindle of a drill to provide the drill with a percussion function. It further comprises at least a stationary percussion cam, an output shaft which is connected to the output spindle of the drill in a coaxial manner wherein said output shaft can be selectively moved to an working position from a normal position, this output shaft further includes a rotary cam by which the output shaft may rotate synchronously with the spindle of the drill, and a clutch mechanism which retains the output in the normal position and permits the output to be moved to a working position. When the output shaft is moved to the working position, the percussion cam is in contact with the rotary cam which is rotating such that the rotary cam generates a periodical hammer movement in the axial direction. Consequently, the output shaft is provided with a hammer movement. By this arrangement, the drill can be readily mounted with the present invention to improve the functions of the drill.

3 Claims, 3 Drawing Sheets

ROTATE PERCUSSION HAMMER/DRILL SHIFT DEVICE

BACKGROUND OF THE INVENTION

The present invention relates to a rotate percussion hammer/drill shift device that may readily be disposed on a hand drill to provide the hand drill with a percussion function.

It is known to provide the hand drill with a hammer function. For example, U.S. Pat. No. 3,931,744, issued to Robert Bosch G.m.b.H., "Hammer-Drill" has disclosed a hand drill with hammer function. The hand drill disclosed above has disposed with a spindle 15 which may oscillate in axial direction and an impact member 28 sleeved onto the peripheral of the spindle 15. The impact member 28 includes a plurality of cams 34–36 which are surrounded to the peripheral of the impact member 28. The impact member 28 can be rotated with the spindle 15 simultaneously. This impact member 28 is further connected with a spring washer 29 and spring 27, gear 14, spring 18 and a knob 21. The impact member 28 may selectively contact with roller bodies 40–42. By this arrangement, when the spindle is rotated, a hammer action provided by the impact member 28 is supplied to the spindle 15.

U.S. Pat. No. 5,277,259, "Hammer Drill With Hammer Drive Action Coupling" has disclosed a hand drill with hammer drive action. U.S. Pat. No. 5,366,025, "Drill And/Or Percussion Hammer" has also disclosed a hand drill with hammer function.

Even there are many a hand drills have been provided with percussion function, all the hand drills use two rotating shafts which are not coaxially. Consequently, it needs more space to receive the shafts. On the other hand, the percussion mechanisms disclosed in the prior art are just suitable for a specified hand drill. It can not be used with other hand drill. By the way, once the percussion mechanism is actuated, it may bring a great deal of vibration to the hand drill before the drill bit is in contact with the work. This will bring inconvenience to the user.

SUMMARY OF THE INVENTION

It is the object of this invention to provide a rotate percussion hammer/drill shift device which may readily be disposed on a hand drill and provide individual percussion function to the hand drill. It also can be readily and conveniently selected to operate with hammer function when needed.

It is still the object of this invention to provide a rotate percussion hammer/drill shift device wherein it can be readily mounted to the existing hand drill. The existing hand drill may readily connect with the rotate percussion hammer/drill shift device by a driving mechanism to output power to the invention. By this arrangement, the hand drill can be provided with a percussion function.

According to one aspect of the present invention, the rotate percussion hammer of the invention is coaxially disposed onto the spindle of the hand drill; consequently, the space received is comparatively reduced.

According to one aspect of the present invention, even the rotate percussion hammer is actuated, before the drill bit is in contact with the working surface, no vibration will be generated. Accordingly, the user may perform the work precisely and smoothly without any inconvenience resulted unwanted vibration.

DETAILED DESCRIPTION OF PREFERRED EMBODIMENT

The rotary percussion mechanism made according to this invention generally comprises at least an output shaft which can be connected to the drill bit by means of a chuck. The output shaft is coaxially disposed with the spindle of the hand drill. It can be coupled by gear or other coupler. By this arrangement, it can be readily mounted to any kind of hand drill which needs a percussion action. A preferable embodiment for merely illustrating will be detailed described as follow.

Figure 1:
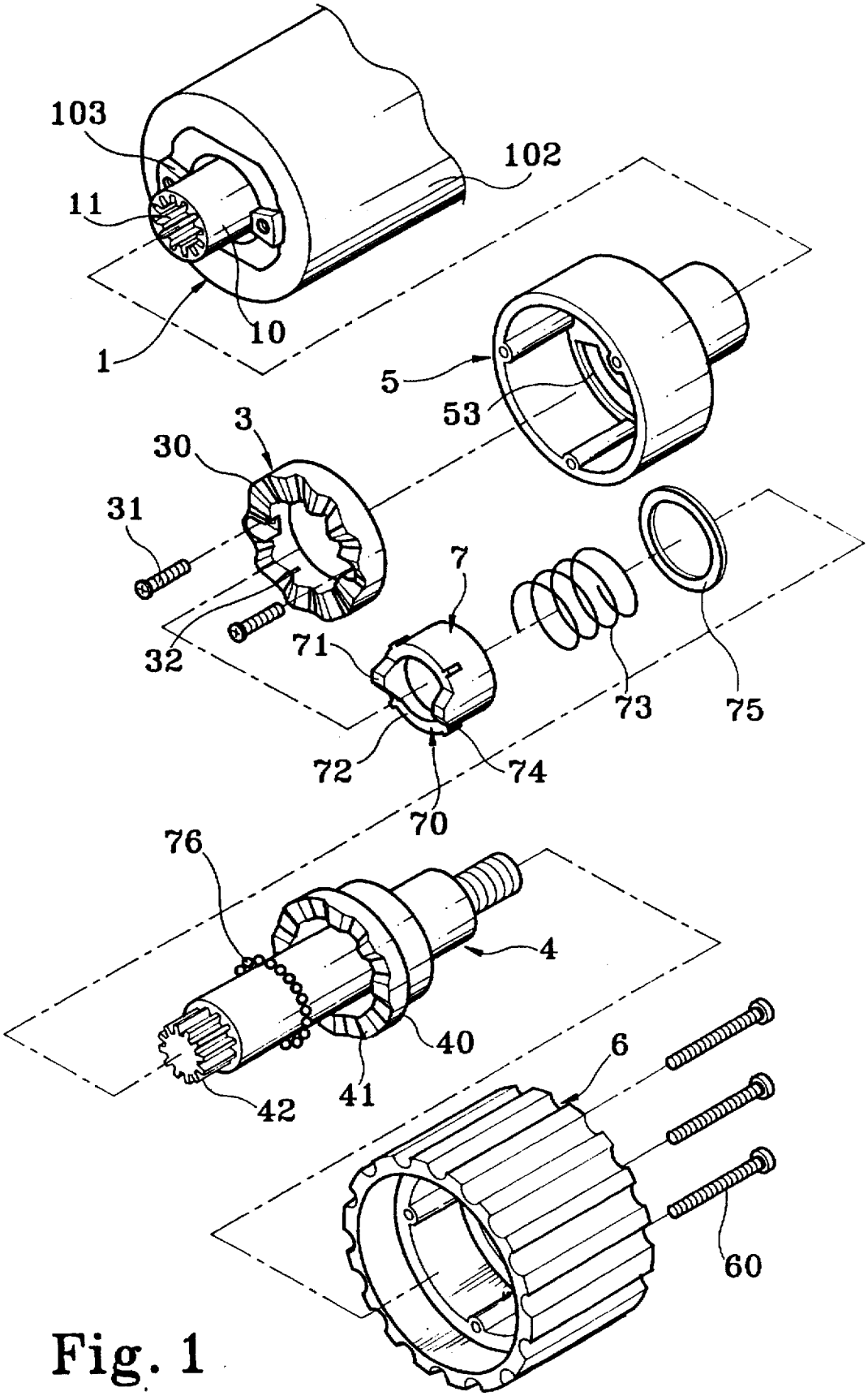
FIG. 1 is an exploded perspective view of the rotate percussion hammer/drill shift device made according to this invention.

Referring to FIG. 1, a drill 1 installed on a rotate percussion hammer/drill shift device according to this invention generally comprises an output spindle 10 which has a hollow and tubular configuration. The inner wall of the output spindle 10 is provided with a teeth portion 11. With this teeth portion 11, an output shaft 4 of the rotate percussion hammer/drill shift device can be coaxially connected. This output shaft 4 further includes a rotary cam 40 by which the output shaft 4 may rotate synchronously with the output spindle 10 of the drill 1. The output spindle 10 is further enclosed by a tubular housing 102 and projected threaded socket 103 which is disposed at one end of the tubular housing 102.

The rotate percussion hammer/drill shift device at least comprises a stationary percussion cam 3, the output shaft 4 which is connected to the output spindle 10 of the drill 1 in a coaxial manner wherein said output shaft 4 can be selectively moved to an working position from a normal position. A clutch mechanism which retains the output in the normal position and permits the output to be moved to a working position. The percussion cam 3 has a ring-type configuration and is mounted to the threaded socket 103 of the tubular housing 102 by means of screw members 31. The screw members 31 pass through a sector hole 53 of a clutch cam 5 of the clutch mechanism. By this provision, the clutch cam 5 and the percussion cam 3 are attached firmly to the tubular housing 102. Besides, the projected threaded socket 103 is received within the sector hole 53. Accordingly, the clutch cam 5 is limited to rotate within a specified ranges, i.e. the clutch cam 5 can only be switched between a normal position or a working position.

The percussion cam 3 includes a first teeth portion 30 directed to the output spindle 10. The teeth portion 30 has a trapezoid cross section in the tangential direction with the percussion cam 3. A second teeth portion 41 is disposed at surface of the rotary cam 40 corresponding to the first teeth portion 30 wherein the first and second teeth portions 30 and 41 can engaged with each other. During the normal operation, the first and second teeth portions 30 and 41 are separated from each other. A follower gear 42 which can be engaged with the teeth portion 11 is disposed at one end of the output shaft 4. The other end is the chuck (not shown) of the drill. Even when the follower gear 42 of the output shaft 4 is engaged with the output spindle 10, there is still enough space for axial displacement. Accordingly, the output shaft 4 can be moved to a working position wherein the first and second teeth portions 30 and 41 are engaged with each other.

Figure 2:
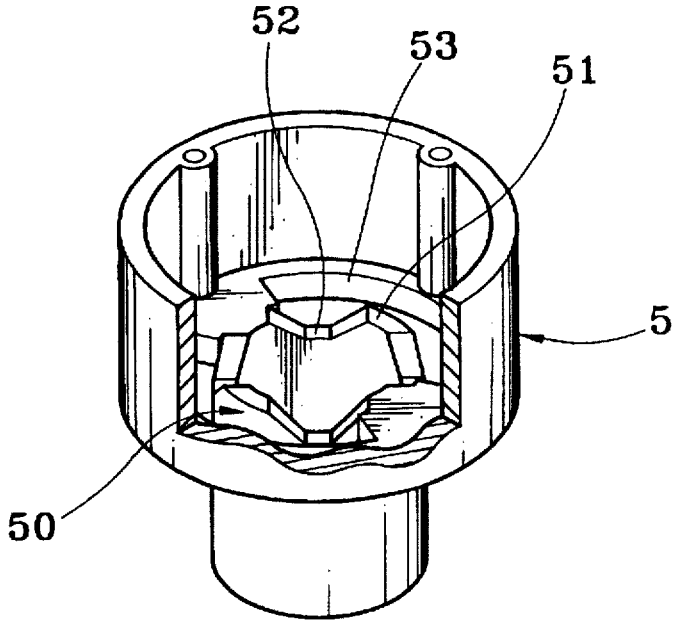
FIG. 2 is a partly cross sectional view of the present invention wherein the clutch cam thereof is disclosed.

The above-mentioned clutch mechanism includes a clutch cam 5 which is disposed to perform an angular movement centered on the output shaft 4. An annular controlling ring 6 is connected to the clutch cam 5 by a plurality of screws 60. A clutch member 7 is sleeved onto the output shaft 4. The clutch cam 5 further includes a stopper 50 disposed at the central position of the clutch cam 5, as clearly shown in FIG. 2. A sector hole 53 which may receive the projected threaded socket 103 is also provided. The sector hole 53 is further limited by the threaded socket 103. The controlling ring 6 is selected between a normal position and a working position. The stopper 50 has a ring-type configuration wherein the output shaft 4 may loosely pass therethrough. The axial end portion of the stopper 50 is provided with a stop peak portion 51 and a stop valley portion 52 which are disposed at different axial positions. The clutch 7 has a ring configuration and the output shaft 4 can pass through loosely. The clutch 7 is provided with a meshing surface 70 which is projected toward the stopper 50. The meshing surface 70 has also a peak portion 71 and a valley portion 72 such that the meshing surface 70 can be engaged with the stop peak portion 51 and the stop valley portion 52. The clutch 7 is further includes a plurality of keyways 74 at the outer surface and those keyways 74 are parallel to the axis of the clutch 7. The percussion cam 3 is also provided with a plurality of spline 32 at the inner wall. Those keyways 74 may slidably engaged with the splines 32. The other end of the clutch 7 is connected to the output shaft 4. A first spring 73 is provided wherein the clutch 7 is biased such that the meshing surface 70 may selectively contact with the stop peak portion 51 or stop valley portion 52.

Figure 3:
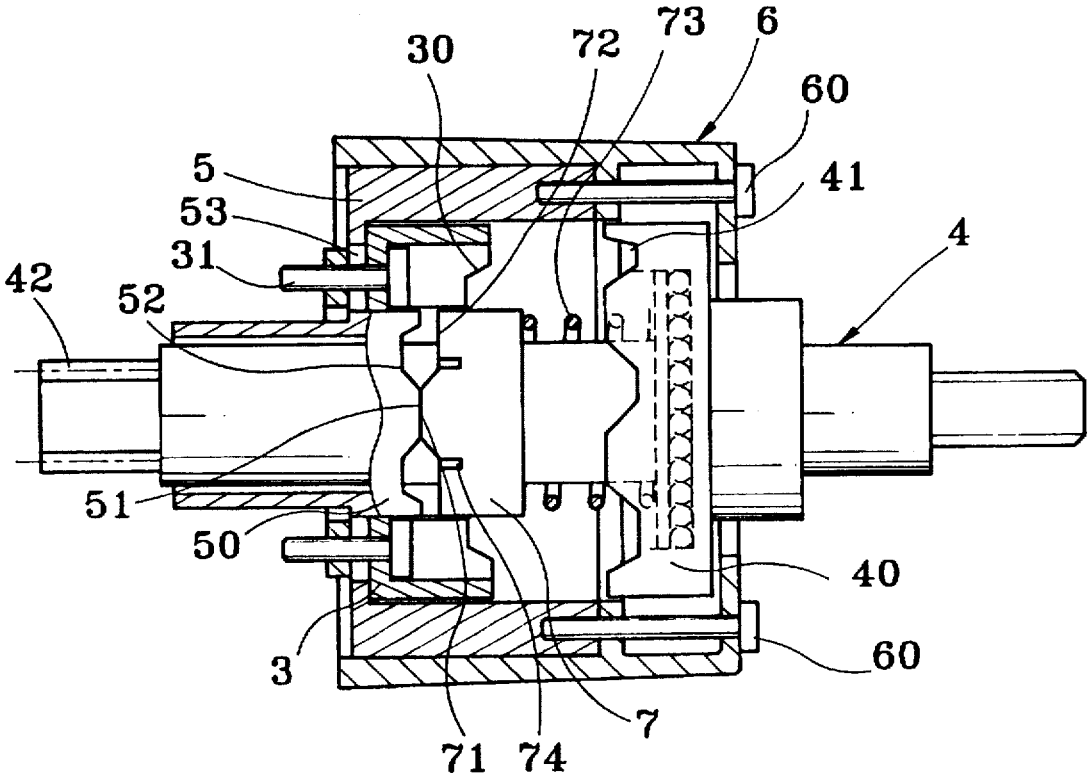
FIG. 3 is still a cross sectional view showing the rotate percussion hammer/drill shift device is not selected for hammering.

In normal position, the stop peak portion 51 of the stopper 50 is contacted with the peak portion 71 of the meshing surface 70, as clearly shown in FIG. 3. In this position, even an axial force resulted from the engagement between the drill bit and workpiece is exerted to the output shaft 4, as by the provision of the stopper 50 and the clutch 7, the second teeth portion 41 of the output shaft 4 is still disengaged with the first teeth portion 31 of the percussion cam 3. In light of this, the drill bit may only operate in a normal way.

Figure 4A:
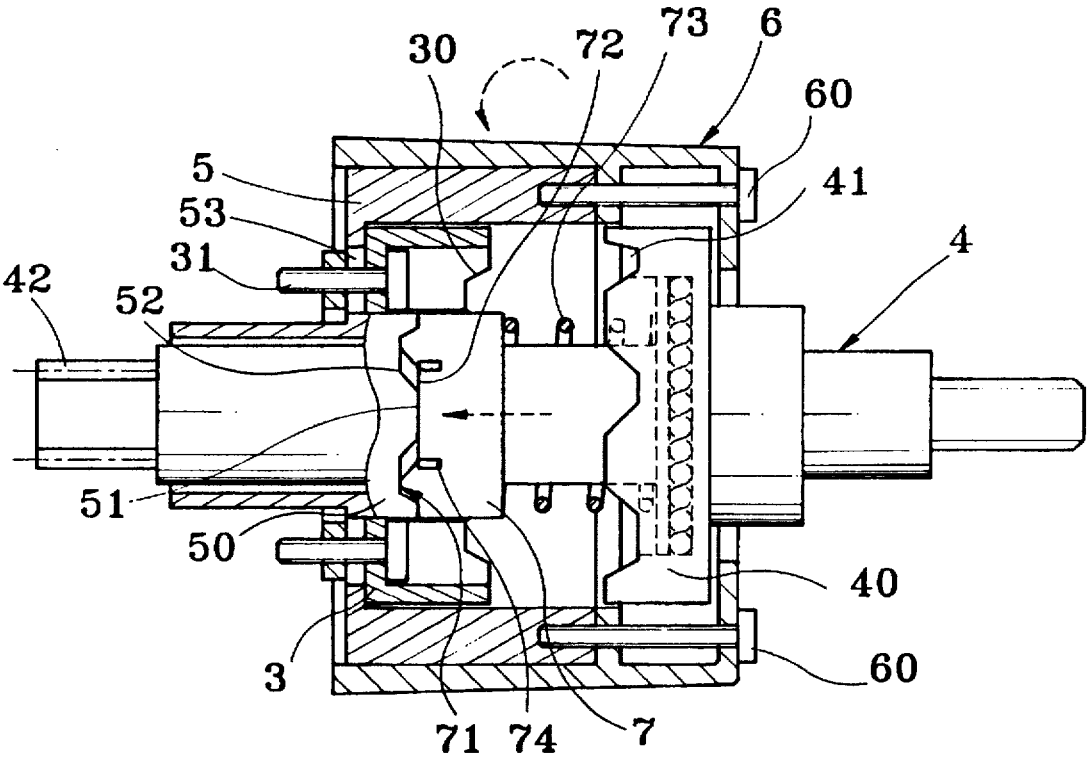
FIG. 4A is still a cross sectional view showing the rotate percussion hammer/drill shift device is selected for hammering.
Figure 4B:
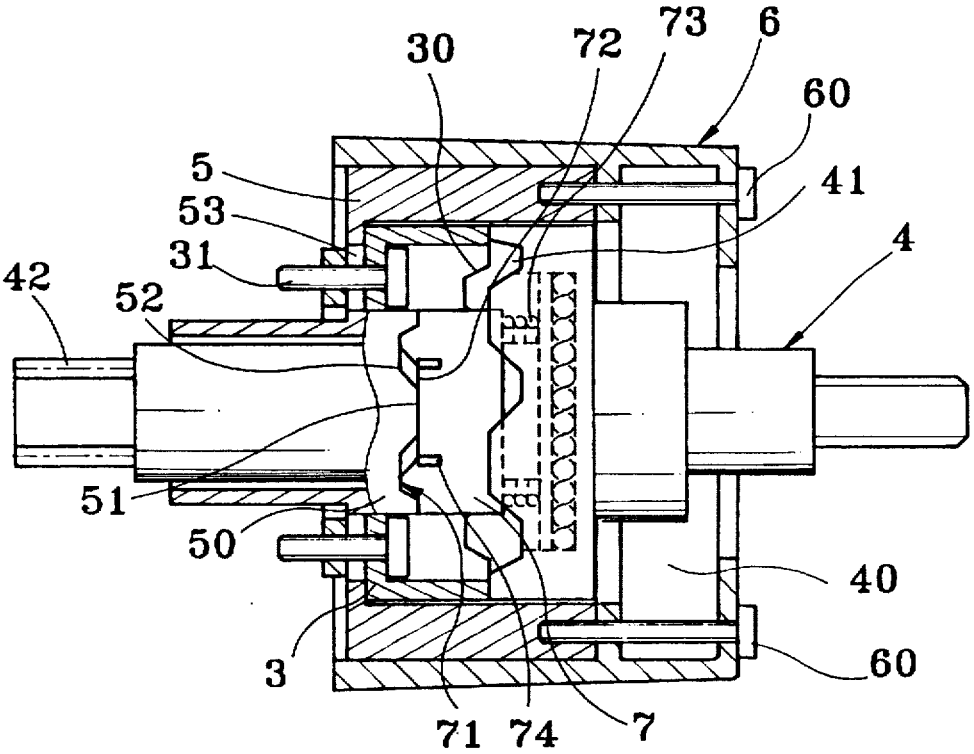
FIG. 4B is an schematic illustration for rotate percussion hammer/drill shift device wherein the output shaft is pushed such that the rotary cam is engaged with the percussion cam.

When the percussion movement is required, the control ring 6 is rotated such that the stop peak portion 51 of the clutch cam 5 is aligned with the valley portion 72 of the meshing surface 70. When the drill bit is in contact with the workpiece, the axial force resulted from the engagement between the drill bit and workpiece is exerted to the output shaft 4 such that the stop peak portion 51 of the clutch cam 5 is meshed with the valley portion 72 of the meshing surface 70, as shown in FIG. 4A. And the first teeth portion 30 is moved to engage with the second teeth portion 41 of the output shaft 4, as shown in FIG. 4B. During the rotation of the output shaft 4, the first and second teeth portions 30 and 41 are slidably engaged with each other. Accordingly, an axial percussion driving force is generated by the slidably engagement between the first and second teeth portions 30 and 41. By this arrangement, the workpiece can be readily machined by the help of the percussion force.

From the forgoing description, it can be readily appreciated that by the means of a threaded socket 103 together with screws 31, the output shaft 4 can be readily coupled with the spindle 10. Consequently, the hand drill is provided with a percussion function.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A rotate percussion hammer/drill shift device suitable for mounting on a hand drill comprising:

a drill comprising a tubular housing, at least an output spindle and a threaded socket disposed at the same side of said tubular busing;

at least a stationary percussion cam disposed at suitable position at said drill, an output shaft connected to said output spindle of said drill in a coaxial manner wherein said output shaft can be selectively moved to a working position from a normal position, said output shaft further including a rotary cam by which said output shaft may rotate synchronously with said spindle of the drill;

a clutch mechanism retaining said output shaft in a normal position or a working position, said clutch mechanism comprising:

a clutch cam which is disposed to perform an angular movement centered on said output shaft, an annular controlling ring being connected to said clutch cam by a plurality of screws, a clutch member being sleeved onto said output shaft, said clutch cam further including a stopper disposed at a central position of said clutch cam, a sector hole which may receive the projected threaded socket being provided, an axial end portion of said stopper being provided with a stop peak portion and a stop valley portion which are disposed at different axial positions, said clutch being configured with a ring configuration and wherein said output shaft can pass through loosely, said clutch being provided with a meshing surface which is projected toward said stopper, said meshing surface being configured with a peak portion and a valley portion, the other end of said clutch being connected to said output shaft, a first spring being provided wherein the clutch is biased such that the meshing surface may selectively contact with the stop peak portion or stop valley portion, wherein when said controlling ring is rotated to the working position, said stop peak portion is engaged with the valley portion and when said controlling ring is moved to a normal position, the stop peak portion is disengaged with the valley portion.

2. The rotate percussion hammer/drill shift device as mentioned in claim 1, wherein the percussion cam is mounted to said threaded socket by screw members.

3. The rotate percussion hammer/drill shift device in claim 1, wherein said percussion cam is provided with a first teeth portion projected axially and said rotary cam is also provided with a second teeth portion which can be engaged with said first teeth portion.

* * * * *